United States Patent [19]

Gundlach

[11] 4,080,897

[45] Mar. 28, 1978

[54] SELECTIVE TACK IMAGING AND PRINTING

[75] Inventor: Robert W. Gundlach, Victor, N.Y.

[73] Assignee: Xerox Corporation, Stamford, Conn.

[21] Appl. No.: 757,521

[22] Filed: Jan. 7, 1977

[51] Int. Cl.[2] ..... B41M 1/08; B41C 1/10

[52] U.S. Cl. ..... 101/467; 96/27 R; 101/471; 250/316; 250/504; 346/76 L; 428/909; 101/451

[58] Field of Search ..... 101/450–457, 101/460–463, 467, 468, 470, 471; 346/76 L; 96/27 R; 250/316, 504

[56] References Cited

U.S. PATENT DOCUMENTS

| | | | |
|---|---|---|---|
| 3,414,724 | 12/1968 | Kvarnegard | 101/470 |
| 3,554,836 | 1/1971 | Steindorf | 101/426 |
| 3,655,379 | 4/1972 | Gundlach | 96/27 R |
| 3,716,359 | 2/1973 | Sheridon | 101/DIG. 13 |
| 3,787,210 | 1/1974 | Roberts | 96/27 E |
| 3,986,874 | 10/1976 | Marsh | 101/471 |

OTHER PUBLICATIONS

Xerox Disclosure Journal; vol. 1, No. 11/12, Nov/Dec. 1976, p. 19.

IBM Technical Disclosure Bulletin; vol. 7, No. 3, Aug. 1964, p. 224.

Xerox Disclosure Journal, vol. 1, No. 3, Mar. 1976, p. 29.

*Primary Examiner*—Clyde I. Coughenour

*Attorney, Agent, or Firm*—V. V. Ralabate; V. P. O'Sullivan; D. M. MacKay

[57] ABSTRACT

Methods of imaging and printing are provided whereby a transparent self-supporting substrate is coated with a transparent abhesive polymer and an image formed by inking said polymer and simultaneously subjecting said polymer to electromagnetic radiation to reduce the cohesive force of said ink or increase the adhesive force so as to selectively deposit ink in image configuration on said adhesive polymer, and transferring said inked image to a receiver sheet.

5 Claims, 2 Drawing Figures

SELECTIVE TACK IMAGING AND PRINTING

BACKGROUND OF THE INVENTION

This invention relates to novel methods of imaging and printing whereby ink is transferred to and from an abhesive polymer.

In conventional lithography an aqueous fountain solution is employed to prevent the ink from wetting the nonimaged areas of the planographic plate. It has recently been discovered that the requirement for a fountain solution can be obviated by employing a planographic plate having a silicone, i.e., organopolysiloxane, elastomeric layer. Because the silicone is not wetted by the printing ink, no fountain solution is required.

In accordance with this invention, a method is provided for depositing and transferring ink from the silicone in image configuration.

BRIEF DESCRIPTION OF THE INVENTION

It has now been discovered that ink can be deposited and transferred from a normally ink releasing surface. Moreover, it has been discovered that the ink can be selectively deposited and transferred in image configuration without altering the surface of the abhesive polymer. In accordance with the invention, the novel deposition and transfer of ink from a normally ink releasing surface is obtained by first coating a transparent, self-supporting substrate with an abhesive polymer. An image is then formed by inking said polymer while simultaneously subjecting the inked polymer to electromagnetic radiation in image configuration to reduce the cohesive force of the ink and/or increase the adhesive force so as to selectively deposit ink in image configuration on said abhesive polymer followed by transferring the resultant inked image to a receiver sheet.

DETAILED DESCRIPTION OF THE INVENTION

Figure 1:
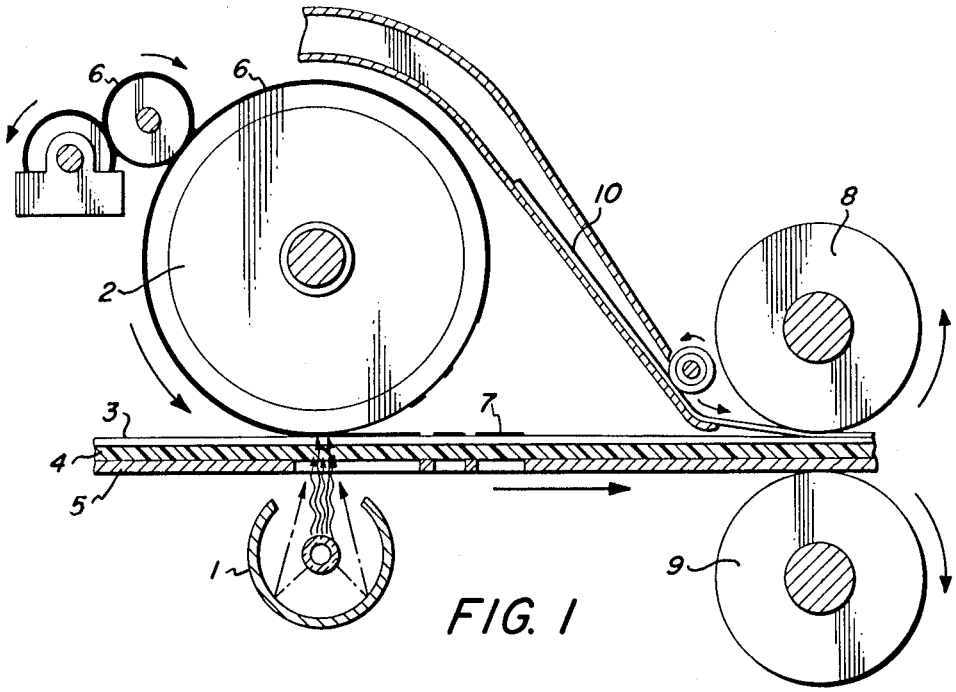
Referring now to FIG. 1, there is depicted an inking roll 2 in operative contact with a transparent abhesive layer 3 coated on a transparent, self-supporting substrate 4. A light source 1 projected through transparency 5 forms the image and causes the ink to be deposited on the abhesive polymer selectively in irradiated areas.

In accordance with the invention, a transparent abhesive polymer is coated on a self-supporting transparent substrate to form a master. In FIG. 1, the master is in the form of a web in which 3 is the abhesive polymer for the transparent substrate and 5 a transparency image. Activating electromagnetic radiation 1 is passed through transparency 5 in image configuration to selectively cause the deposition of some of ink 6 from inking roller 2 onto abhesive polymer 3 to provide an image 7. The activating electromagnetic radiation illustrated by a light source selectively heats the ink to reduce its viscosity to reduce its cohesive force or increase its adhesive force so as to selectively cause its deposition. The inked image is then transferred to receiver sheet 10 when the master is passed through impression rolls 8 and 9.

Figure 2:
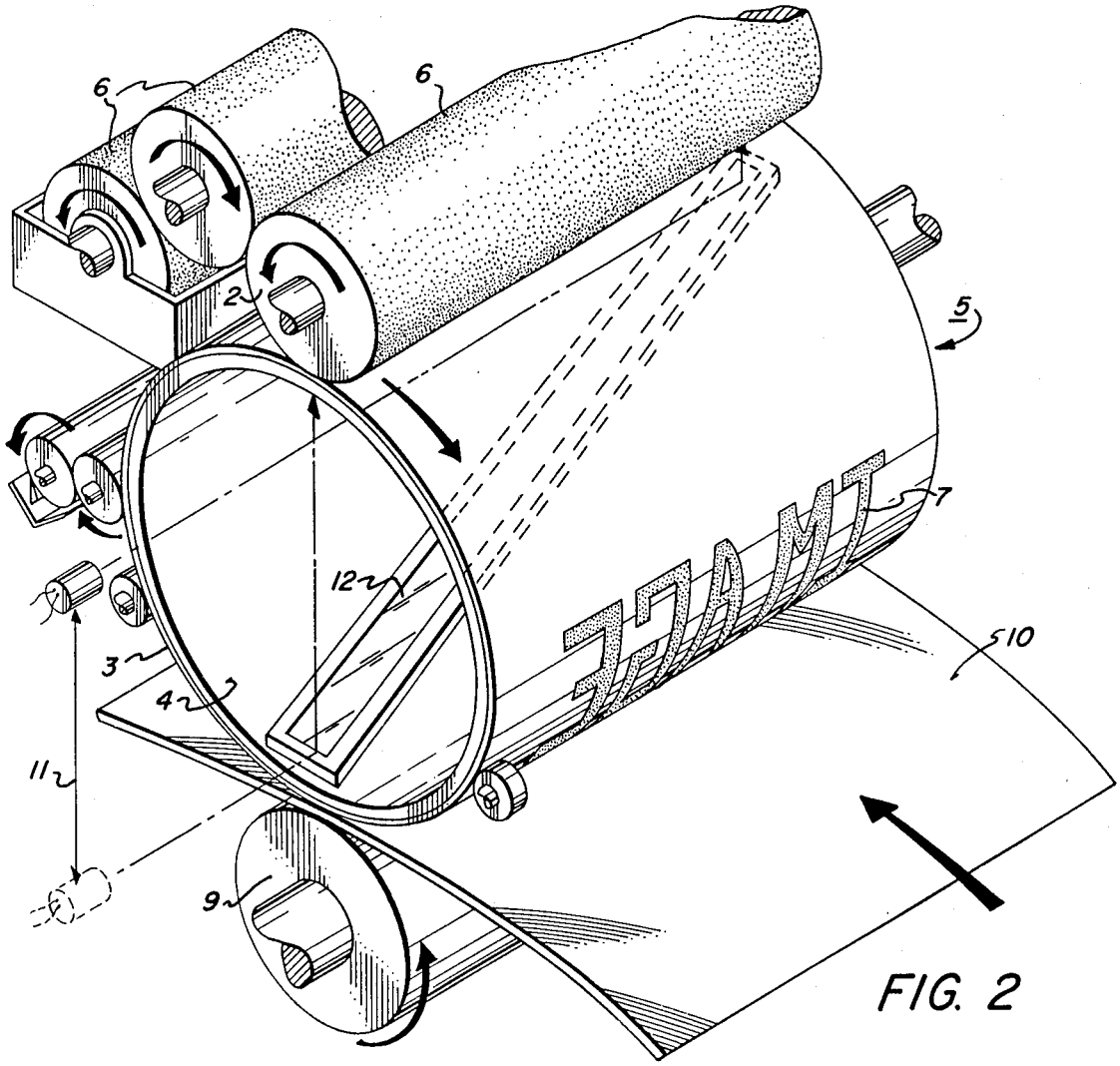
In FIG. 2, a cylindrical transparent substrate 5 coated with an abhesive polymer is imaged from within by direction of a laser scan 11 impinging on plate 12 to direct light in image configuration to inking roller 2 so as to selectively deposit ink in image configuration on master 5.

In FIG. 2, a laser scan 11 is imagewise projected onto plate 12 from within cylinder 5 through a glass substrate 4 so as to selectively heat form roll 2 and cause ink to be deposited in image configuration as image 7. The image is then transferred to paper receiver sheet 10 by passing said sheet between master 5 and impression roller 9.

In accordance with the invention, activating electromagnetic radiation may be supplied such as by visible light or infrared heat. Conventional viscous lithographic inks can be employed such as formed from motor oil and lamp black and the like. Only a minimum amount of energy is required such as from about 0.1 to 0.5 J/cm$^2$. For example, at 180 watts, a page per second can be processed and two pages per second at about 400 watts.

Transparent substrates can be formed from polymers such as polyester, polycarbonate, polysulfone, nylon and polyurethane. Other transparent materials can also be employed such as glass. Conventional inking rollers and other conventional printing equipment are employed in the invention.

Transparent abhesive materials which can be employed in the invention are ink releasable silicones and organohydrocarbons such as derived from a copolymer of ethylene and propylene crosslinked with a diene.

Ink releasable silicones which can be employed in the invention include silicone polymer gums and heterophase polymeric compositions having a silicone phase such as organopolysiloxane copolymers including block copolymers, graft and segmented copolymers, organopolysiloxane polymer blends, and copolymer stabilized polymer blends.

Exemplary of suitable silicone gums are those having only methyl containing groups on the polymer chain such as polydimethylsiloxane; gums having methyl and phenyl containing groups on the polymer chain as well as gums having both methyl and vinyl groups, methyl and fluorine groups, or methyl, phenyl and vinyl groups on the polymer chain.

Typical silicone gums which are of the thermally curable type suitable for use in the invention as elevated temperature gums are Syl Gard #182, Syl Off #22 and #23 manufactured by Dow Corning, Midland, Michigan; Y-3557 and Y-3602 silicone gum available from Union Carbide Company, New York, New York, as well as #4413 silicone and #4427 heat curable silicone gums available from General Electric Company, Waterford, New York. The Y-3557 and Y-3602 gums specifically have aminoalkane crosslinking sites in the polymer backbone which react with a diisocyanate crosslinking agent over a wide range of temperature and time to produce a durable, ink releasable elastomeric film. The aforesaid gums do not contain a catalyst.

Exemplary of suitable room temperature vulcanizable gums which can be cured at ambient temperature and atmospheric conditions include RTV-108, 106 and 118 polydimethylsiloxane gums available from General Electric Company.

Ink releasing copolymers which can be employed and coalesced at elevated temperature comprise heterophase polymeric compositions consisting of an organopolysiloxane material and a nonsilicone polymeric material. Polymeric materials which can be employed as the nonsilicone component of the heterophase polymeric composition include materials such as poly (alpha-methyl-styrene), polycarbonate, polysulfone, polystyrene, polyester, polyamide, acrylic polymers, polyurethane, and vinyl polymers.

While not limiting, preferred proportions for the heterophase polymeric composition comprise a ratio by weight of between about 95 to 50 parts organopolysiloxane to 5 to 50 parts of the nonsilicone polymeric phase. This ratio range of organopolysiloxane to nonsilicone polymer, provides suitable ink release materials for the ink release layer of the instant printing master. Copolymers of the above type, could be typically prepared in a manner as illustrated by the procedure for preparation of an organopolysiloxane/polystyrene block copolymer as described in Macromolecules, Volume 3, January-February 1970, pages 1-4.

The abhesive material can be applied to the transparent substrate by conventional means such as spraying, draw bar coating and the like. The thickness of the abhesive material will depend upon the material employed but generally should be at least about 1 mil and preferably at least about 2 mils with no upper limit. For best results, the abhesive material should have a durometer of between about 50 and about 80 Shore A with normal printing pressures of 50 to 100 p.s.i.

Conventional inks and printing equipment can be employed. The ink should be absorbent to the activating electromagnetic radiation so various colored inks may not abosrb infrared radiation and thus require visible irradiation. Carbon black inks are preferred as they are excellent absorbers of electromagnetic radiation throughout the visible and infrared spectrum.

The tack value or viscosity of the ink required is dependent upon the speed of separation of the ink from the abhesive surface. For example, a low viscosity ink (0.5-10 poise) when the press is operated at low speeds is found to split rather than separate cleanly from the abhesive surface in the background areas. Thus, high speeds and viscous inks (100-800 poise) are preferred although one can be decreased with a concomitant increase in the other.

The following example will serve to illustrate the invention. All parts and percentages in said example and elsewhere in the specification and claims are by weight unless otherwise specified.

EXAMPLE

In accordance with the apparatus of FIG. 1, an abhesive film of General Electric RTV-108 elastomer gum was coated to a thickness of approximately 1 mil on a transparent substrate of 2 mil Mylar. The composite was taped over a negative transparency on a glass substrate and a xenon flash lamp emitting about $\frac{1}{2}$J/cm$^2$was mounted behind the glass and flashed as an ink roller was advanced along the abhesive surface. The viscous lithographic ink was caused to deposit on the abhesive polymer during flashing of the lamp so as to cause the ink to split and deposit on the abhesive surface only in the illuminated areas. The image was then transferred to a paper receiver sheet.

Having described the present invention with reference to these specific embodiments, it is to be understood that numerous variations can be made without departing from the spirit of the invention and it is intended to encompass such reasonable variations or equivalents within its scope.

What is claimed is:

1. A method of printing which comprises:

(a) providing a transparent self-supporting substrate, (b) applying a coating to said substrate of a transparent, abhesive polymer, (c) placing said abhesive coating in contact with an ink surface and simultaneously subjecting said abhesive coating and ink to activating electromagnetic radiation in image configuration, in an amount and for a time sufficient to selectively deposit ink in said image configuration on said abhesive coating, and (d) transferring said inked image to a receiver sheet.

2. The method of claim 1 wherein the abhesive polymer is formed of a silicone elastomer.

3. The method of claim 1 wherein the abhesive polymer is applied to a cylindrical substrate and the polymer and ink subjected to activating electromagnetic radiation by direction of a laser scan from the inner surface of said cylinder.

4. The method of claim 1 wherein a planar substrate is provided.

5. The method of claim 4 wherein an image transparency is placed between said substrate and said abhesive polymer and activating electromagnetic radiation applied to the underside of said substrate.

* * * * *